US009845937B2

(12) United States Patent
Hou et al.

(10) Patent No.: US 9,845,937 B2
(45) Date of Patent: Dec. 19, 2017

(54) FIELD LIGHT CONTROL SYSTEM FOR LED LUMINAIRES

(71) Applicant: ABL IP Holding LLC, Decatur, GA (US)

(72) Inventors: Bin Hou, Schaumburg, IL (US); James G. Brand, Mount Prospect, IL (US)

(73) Assignee: ABL IP Holding LLC, Atlanta, GA (US)

( * ) Notice: Subject to any disclaimer, the term of this patent is extended or adjusted under 35 U.S.C. 154(b) by 37 days.

(21) Appl. No.: 14/878,501

(22) Filed: Oct. 8, 2015

(65) Prior Publication Data

US 2017/0102126 A1 Apr. 13, 2017

(51) Int. Cl.

| | |
|---|---|
| ***F21V 13/02*** | (2006.01) |
| ***F21V 17/06*** | (2006.01) |
| ***F21V 7/04*** | (2006.01) |
| *F21Y 115/10* | (2016.01) |

(52) U.S. Cl.

CPC ..... *F21V 13/02* (2013.01); *F21V 7/041* (2013.01); *F21V 17/06* (2013.01); *F21Y 2115/10* (2016.08)

(58) Field of Classification Search

CPC ..... F21V 7/041; F21V 13/02; F21V 17/04; F21V 17/06

USPC ..... 362/456

See application file for complete search history.

(56) References Cited

U.S. PATENT DOCUMENTS

| | | | | |
|---|---|---|---|---|
| 5,432,683 | A * | 7/1995 | Brown | F21V 7/0016 362/16 |
| 6,851,834 | B2 * | 2/2005 | Leysath | F21S 8/04 362/240 |
| 7,922,366 | B2 | 4/2011 | Li | |
| 8,220,959 | B2 | 7/2012 | Rizkin et al. | |
| 8,882,311 | B2 * | 11/2014 | Snell | F21V 13/04 362/147 |
| 8,992,052 | B2 | 3/2015 | Cai et al. | |
| 2003/0189832 | A1 | 10/2003 | Rizkin et al. | |
| 2012/0218764 | A1 * | 8/2012 | Williamson | F21V 29/20 362/294 |
| 2014/0334126 | A1 * | 11/2014 | Speier | F21V 7/0091 362/84 |

(Continued)

OTHER PUBLICATIONS http://www.khatod.com/khatod/view_products?KCLP1856CR_Reflectors_for_LUXEON_LEDs_Narrow_Beam,3875,1, Oct. 5, 2015.

*Primary Examiner* — Alan Cariaso

(74) *Attorney, Agent, or Firm* — Kilpatrick Townsend & Stockton, LLP

(57) ABSTRACT

An optical assembly for an LED light system with a LED light source is provided to control a light pattern of a light beam produced by the system, such as for spot or narrow flood light applications. The optical assembly includes a conical reflector with an interior reflective surface, a light diffuser and an optic holder. The light diffuser has an annular disk-shape with a central opening. The optic holder is mounted to a narrow open top of the reflector, and suspends the light diffuser inside of the reflector along an optical axis. The light diffuser is a cost-efficient optical element, which can be used in combination with the reflector to redistribute light in the system in order to soften a peripheral light area surrounding a center beam light area of the light pattern of the light beam, and reduce a harsh edge between the center beam and peripheral light areas.

20 Claims, 9 Drawing Sheets

(56) References Cited

U.S. PATENT DOCUMENTS

2015/0167931 A1* 6/2015 Borgarelli ..... F21V 7/00
362/297
2015/0338059 A1* 11/2015 Allen ..... F21V 7/0033
362/300

* cited by examiner

Primary Optic Only

600

Primary Optic and Optical Medium

640

Primary Optic with 2nd Optic and Optical Medium

680

FIELD LIGHT CONTROL SYSTEM FOR LED LUMINAIRES

FIELD

The present disclosure is related to an LED light system, and more particularly, to an optical assembly to control a light pattern of a light beam for a spot or narrow flood LED-type light system.

BACKGROUND

Traditional light sources include incandescent, high-intensity discharge (HID), and compact-fluorescent (CFL) light sources, all of which emit light in all directions (i.e., non-directional light beam). To direct the non-directional light beam down from and out of a recessed fixture, lighting manufacturers have traditionally designed reflectors using a parabolic shape, which is intended to focus the non-directional light beam toward an illuminated target (e.g., a floor or wall surface). Rapid advancements in light-emitting diode ("LED") technology have caused manufacturers to replace the traditional light sources with LED light sources, which are inherently directional light sources. The manufacturers have continued using traditional reflectors (e.g., parabolic-shaped reflectors) to minimize glare; however, LED light sources are inherently less diffuse emitters than these traditional light sources resulting in additional lighting designs concerns. For example, the combination of LED light sources with a traditional reflector may produce a light beam with a light pattern having a harsh edge between a center beam light area and a peripheral light area (surrounding the center beam light area) of the light beam, which is aesthetically unappealing in spot or narrow flood light applications.

SUMMARY

In an LED light system of the spot or narrow flood variety, and especially for the interior lighting variety, it is desirable that the LED light system produces a light beam with a light pattern that provides a smooth or smoother transition, without harsh edges, between a center beam light area and a peripheral light area (surrounding the center beam light area) of the light beam. It is also desirable that the peripheral light area of the light beam is softened and blended into a surrounding darkness, while maintaining a center beam light area with a high Center Beam Candlepower. It is further desirable that this smooth transition be accomplished in a cost-efficient manner and preferably results in a broader area of illumination. To address these and other issues, an improved and cost-efficient optical assembly is provided for a LED light system, in which a light diffuser with a central opening is suspended inside of the reflector to redistribute light received from the LED light source. The light diffuser redistributes light to soften and broaden out the peripheral light area, thereby providing a smooth or smoother transition between the center beam and peripheral light areas of the light beam. At the same time, the central opening of the light diffuser allows light from the LED light source to pass directly therethrough to provide the center beam light area with a sufficiently high light intensity (e.g., a bright center beam with a high Center Beam Candlepower).

In accordance with an embodiment, the LED light system includes an LED light source, an optical assembly and an optic housing (e.g., a housing or mounting frame) to house the LED light source and the optical assembly. The optical assembly includes a conical reflector with a narrow open top and a wide open bottom, a light diffuser, an optic holder to suspend the light diffuser inside of the conical reflector, and an optical medium. The optic holder is mounted to the narrow open top of the reflector, and the optical medium is positioned over or across the wide open bottom of the reflector. The light diffuser has an annular shape with a central opening, and is formed of a light diffusing material to diffuse light received from the LED light source. The optic holder can be designed with a shape and a light-transmissive material (e.g., a light transmitting material) to maximize an overall light output efficiency of the LED light system.

BRIEF DESCRIPTION OF THE DRAWINGS

The description of the various exemplary embodiments is explained in conjunction with the appended drawings, in which.

DETAILED DESCRIPTION OF THE EXAMPLE EMBODIMENTS

As an initial matter, it will be appreciated that the development of an actual, real commercial application incorporating aspects of the disclosed embodiments will require many implementation specific decisions to achieve the developer's ultimate goal for the commercial embodiment. Such implementation specific decisions may include, and likely are not limited to, compliance with system related, business related, government related and other constraints, which may vary by specific implementation, location and from time to time. While a developer's efforts might be complex and time consuming in an absolute sense, such efforts would nevertheless be a routine undertaking for those of skill in this art having the benefit of this disclosure.

It should also be understood that the embodiments disclosed and taught herein are susceptible to numerous and various modifications and alternative forms. Thus, the use of a singular term, such as, but not limited to, "a" and the like, is not intended as limiting of the number of items. Similarly, any relational terms, such as, but not limited to, "top," "bottom," "left," "right," "upper," "lower," "down," "up," "side," and the like, used in the written description are for clarity in specific reference to the drawings and are not intended to limit the scope of the invention.

Before describing the various exemplary embodiments in the present disclosure, a few terms are also discussed below for the explanatory purposes.

A "beam angle" defines the light pattern around the light beam's center out to the angle where the light (luminous) intensity is half that of the maximum luminous intensity.

A "Center Beam Candlepower" is the light intensity at the center of the light beam such as for a reflector-type light system.

A "field angle" is the angular dimension of a cone of light from a light system, which encompasses the central part of the light beam out to the angle where the light intensity is 10% of maximum. The field angle is useful in describing a light output of a light system, particularly where the light output begins to fade into the surrounding environment (e.g., darkness).

A "field light" is the light output of a light system over or across the field angle, or in other words, up until the light output has fallen to 10% of maximum light intensity.

Figure 1:
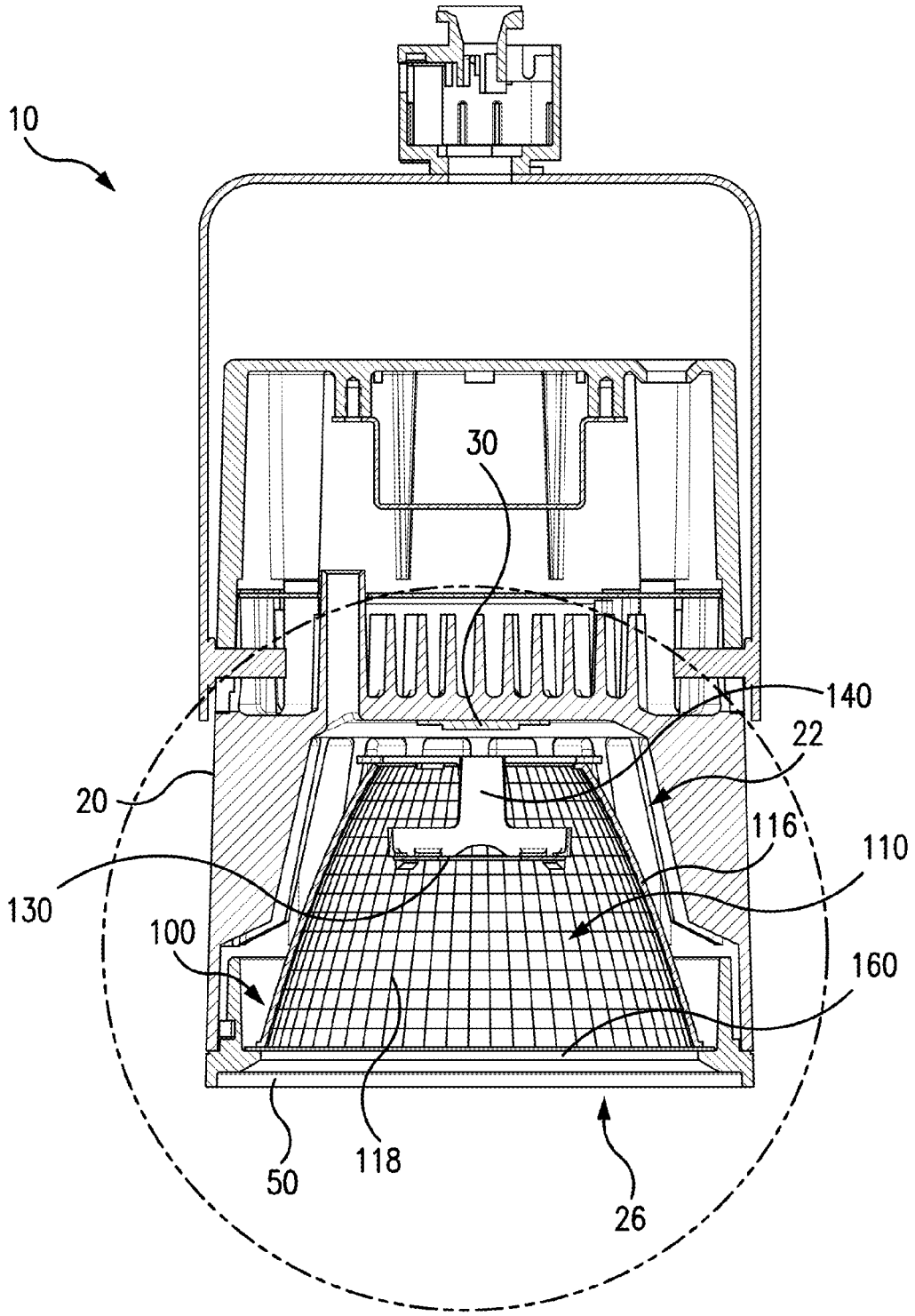
FIG. 1 illustrates a sectional view of an LED light system with an optical assembly which produces a light beam with a light pattern having a smooth transition, without harsh edges, between a center beam light area and a peripheral light area surrounding the center beam light area, in accordance with an exemplary embodiment of the present disclosure.

Turning to the figures, FIG. 1 illustrates an LED light system 10 including an LED light source 30 (e.g., an LED light engine on a PCB) and an optical assembly 100, which are both housed in a cavity 22 of an optic housing 20 through an open end 26. The optical assembly 100 is supported and connected to the optic housing 20, using a media cartridge 50. The LED light system 10 produces a light beam with a light pattern having a center beam light area and a peripheral light beam area surrounding the center beam light area. The LED light system 10 can be a downlight of a spot or narrow flood variety.

The optical assembly 100 includes a reflector 110 (also referred to as "primary optic"), a light diffuser 130 (also referred to as "secondary optic") and an optical medium 160. The light diffuser 130 is suspended inside of the reflector 110 by an optic holder 140, and is configured with a predetermined size and shape and at a predetermined distance from the LED light source 30 to redistribute light, such as the field light. Specifically, the light diffuser 130 redistributes light to soften and broaden out the peripheral light area, and thus, to smooth out a transition between the center beam light area and the peripheral light area of the light beam. The use of the light diffuser 110 provides a simple, cost-efficient optical assembly, which does not require costly and complex optical components, such as additional reflectors, to provide a light beam with a light pattern having a smooth or smoother transition between the center beam light area and the peripheral light area. A detailed description of the various components of the optical assembly 100 will be described in greater detail below with reference to both FIGS. 2 and 3, which show an exploded view and an enlarged assembled view of the optical assembly 100, respectively.

Figure 2:
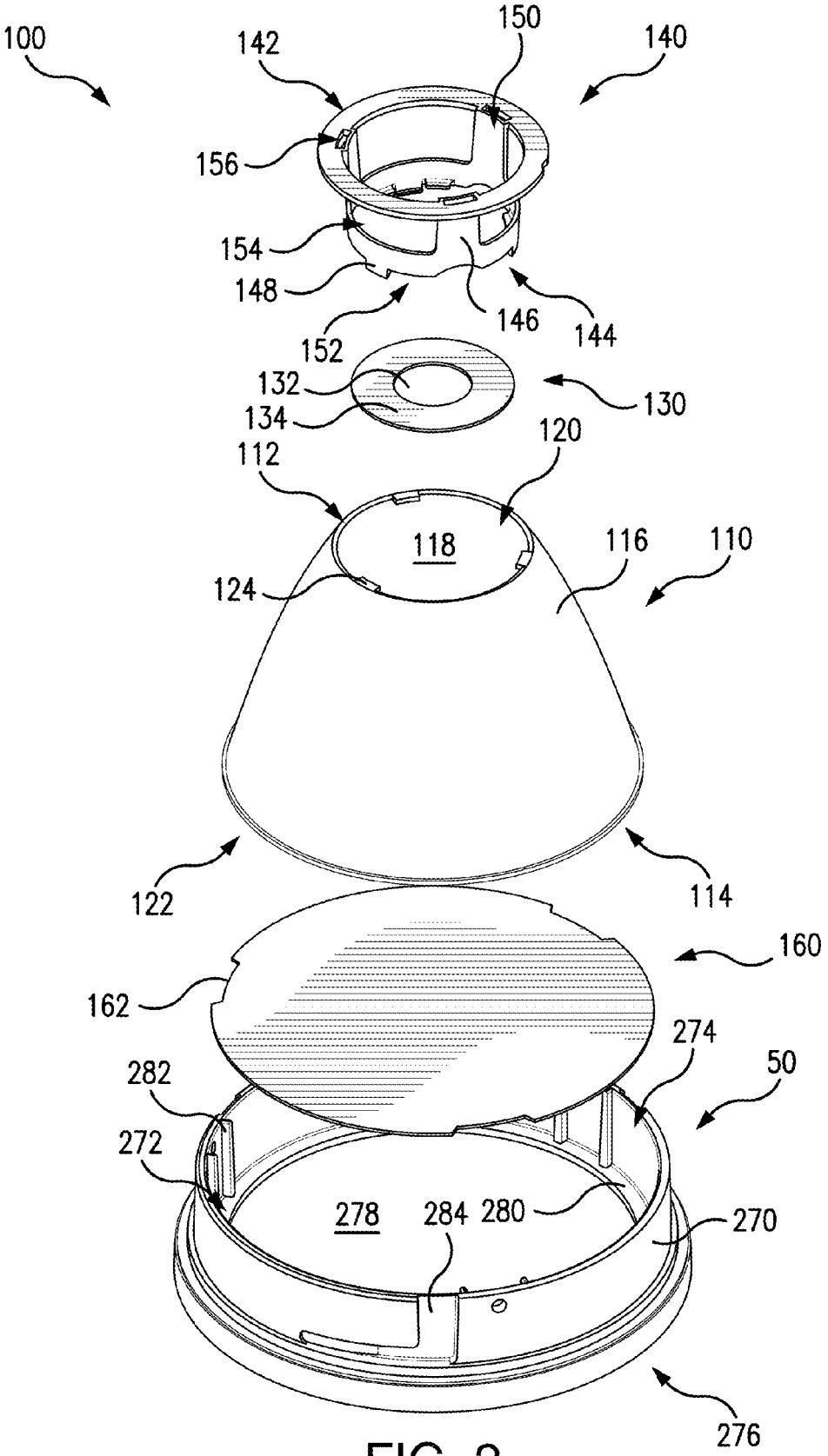
FIG. 2 illustrates an exploded view of the optical assembly of FIG. 1.
Figure 3:
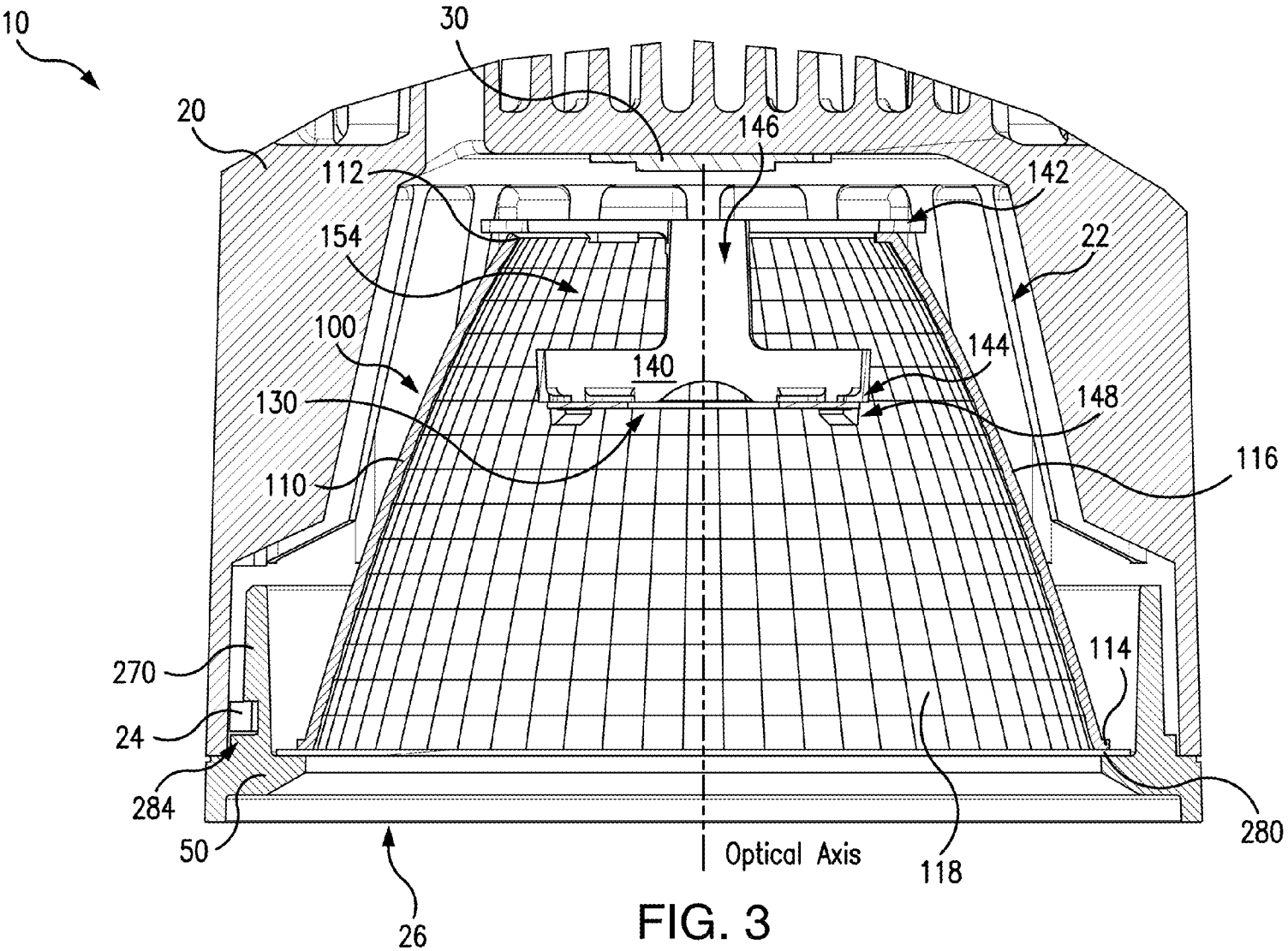
FIG. 3 illustrates a portion of the LED light system of FIG. 1, showing an enlarged sectional view of the LED light source, the optical assembly and the media cartridge when assembled into an optic housing of the LED light system.

As shown in FIGS. 2 and 3, the reflector 110 is a conical or cone-shaped reflector (e.g., a cone reflector) having a narrow open top 112 and a wide open bottom 114. The reflector 110 also includes a wall 116 which extends continuously from a top to a bottom of the reflector 110 and has a continuous interior reflective surface 118. The narrow open top 112 has a top opening 120, and the wide open bottom 114 has a bottom opening 122. The narrow open top 112 includes twist-on tabs 124, which extend into the top opening 120. The twist-on tabs 124 are part of a twist-on assembly, (e.g., a tab and slot assembly), to detachably connect or mount the optic holder 140 to the reflector 110. The reflector 110 can, for example, be an aluminum reflector (e.g., an Alzac processed aluminum reflector) or a prismatic reflector (e.g., an acrylic prismatic reflector).

The light diffuser 130 has an annular shape with a central opening 132 and a disk-shaped portion 134. The disk-shaped portion 134 is formed of a light diffusing material to diffuse light. The light diffusing material can include polycarbonate (e.g., polycarbonate film or lens), blasted glass, textured acrylic, volumetric diffuser, or any suitable material with light diffusing properties. The light diffuser 130 is suspended inside of the reflector 110 by the optic holder 140, which aligns the light diffuser 130 along an optical axis, in this example, a centerline of the optical assembly 100. The light diffuser 130 is used to control light distribution, such as of the field light, to reduce a harsh edge, and thus, to smoothen a transition between the center beam light area and the peripheral light area bordering and surrounding the center beam light area of the light beam produced by the LED light system 10. At the same time, the central opening 132 of the light diffuser 130 allows light from the LED light source 30 to pass directly therethrough to produce a light beam with the center beam light area having a sufficiently high light intensity (e.g., a bright center beam with a high Center Beam Candlepower).

The optic holder 140 includes an upper ring 142 with a central upper opening 150, a lower ring 144 with a central lower opening 152, and a plurality of spaced-apart supports 146 (e.g., vertical supports) connected between the upper and lower rings 142, 144. The optical holder 140 also includes a plurality of spaced-apart windows 154 (e.g., openings) to allow light, such as from a light source (e.g., the LED light source 30 in FIG. 1), to pass directly therethrough. The supports 146 are designed with a height to establish a desired focal length for the optic diffuser 130. The components of the optic holder 140 are formed of a light-transmissive material, e.g., a light transmitting material, to allow light to be transmitted therethrough. The light-transmissive material can include polycarbonate, acrylic, silicone or other materials which are preferably resilient and able to allow light transmission therethrough (e.g., optically transparent). The optical holder 140 can be designed with a structure (e.g., windows) and materials (e.g., light-transmissive materials) to avoid blocking the light from the reflector 110, and to maximize an overall light output efficiency of the LED light system 10, e.g., greater than 70% efficient or preferably between 80% to 85% efficient.

As further shown in FIGS. 2 and 3, the optic holder 140 further includes a snap-fit assembly on the lower ring 144 to detachably connect and support the light diffuser 130. In this example, the snap-fit assembly comprises a plurality of resilient spaced-apart hooks 148, which are configured to support the light diffuser 130 from below and to detachably engage a periphery of the light diffuser 130. The upper ring 142 has a diameter, which is larger than the opening 120 of the narrow open top 112 of the reflector 110. The upper ring 142 also includes a plurality of spaced-apart slots 156 (e.g., slots or grooves) proximate a bottom side of the upper ring 142.

To assemble the light diffuser 130 into the reflector 110, the light diffuser 130 is connected to the lower ring 144 of the optic holder 140 via the hooks 148. The lower ring 144 of the optic holder 140 is then inserted along with the light diffuser 130 through the top opening 120 of the narrow open top 112 of the reflector 110 until the upper ring 142 abuts against the narrow open top 120. Thereafter, the optic holder 140 is twisted until the tabs 124 of the reflector 110 engage corresponding slots 156 of the optic holder 140.

The optical medium 160 is arranged over or across the bottom opening 122 of the wide open bottom 114 of the reflector 110. In this example, the optical medium 160 has a circular shape, and has plurality of spaced-apart notches 162 along an edge of the medium. The optical medium 160 can be formed of a light diffusing material, such as glass or polycarbonate (e.g., a polycarbonate lens) which can have a light diffusing surface. The optical medium 160 can be used to further soften and enhance a continuity of the light pattern of the light beam produced by the LED light system 10.

The media cartridge 50 is provided to support and secure the components of the optical assembly 100 inside the cavity 22 of the optic housing 20. In this example, the media cartridge 50 has a body 270 with a cylindrical shape. The body 270 of the media cartridge 50 includes a top 272 and an opposite bottom 276. The top 272 includes a top opening 274 to receive the optical assembly 100. The bottom 276 includes a bottom opening 278 through which light is outputted. The media cartridge 50 also includes an interior rim 280 (e.g., a rim, lip or flange), a plurality of spaced-apart interior stops 282 and one or more exterior grooves 284. The interior rim 280 is used to support the optical medium 160 and the other components of the optical assembly 100. The interior stops 282 are parallel spaced-apart vertical protrusions, which are configured to engage respective notches 162 of the optical medium 160 and act as a guide when assembling the optical medium 160 into the media cartridge 50. The interior stops 282 prevent horizontal or lateral movement of the optical medium 160, when assembled onto the media cartridge 50. The interior stops 282 can also be used to receive spring clips (not shown), which can be connected to the optic housing 20 and help to guide and align the optical assembly 100 in the optic housing 20.

Once the optical assembly 100 is assembled onto the media cartridge 50, the media cartridge 50 can be inserted through an open end 26 (e.g., an open bottom) of the optic housing 20. The groove(s) 284 of the media cartridge 50 are aligned and engaged with corresponding tab(s) 24 of the optic housing 20 to secure the media cartridge 50, along with the optical assembly 100, to the optic housing 20 of the LED light system 10. As shown in FIG. 3, the LED light source 30 and the optical components of the optical assembly 100 are arranged along an optical axis, which in this example is a centerline axis of the optical assembly 100 and the LED light system 10.

Figure 4:
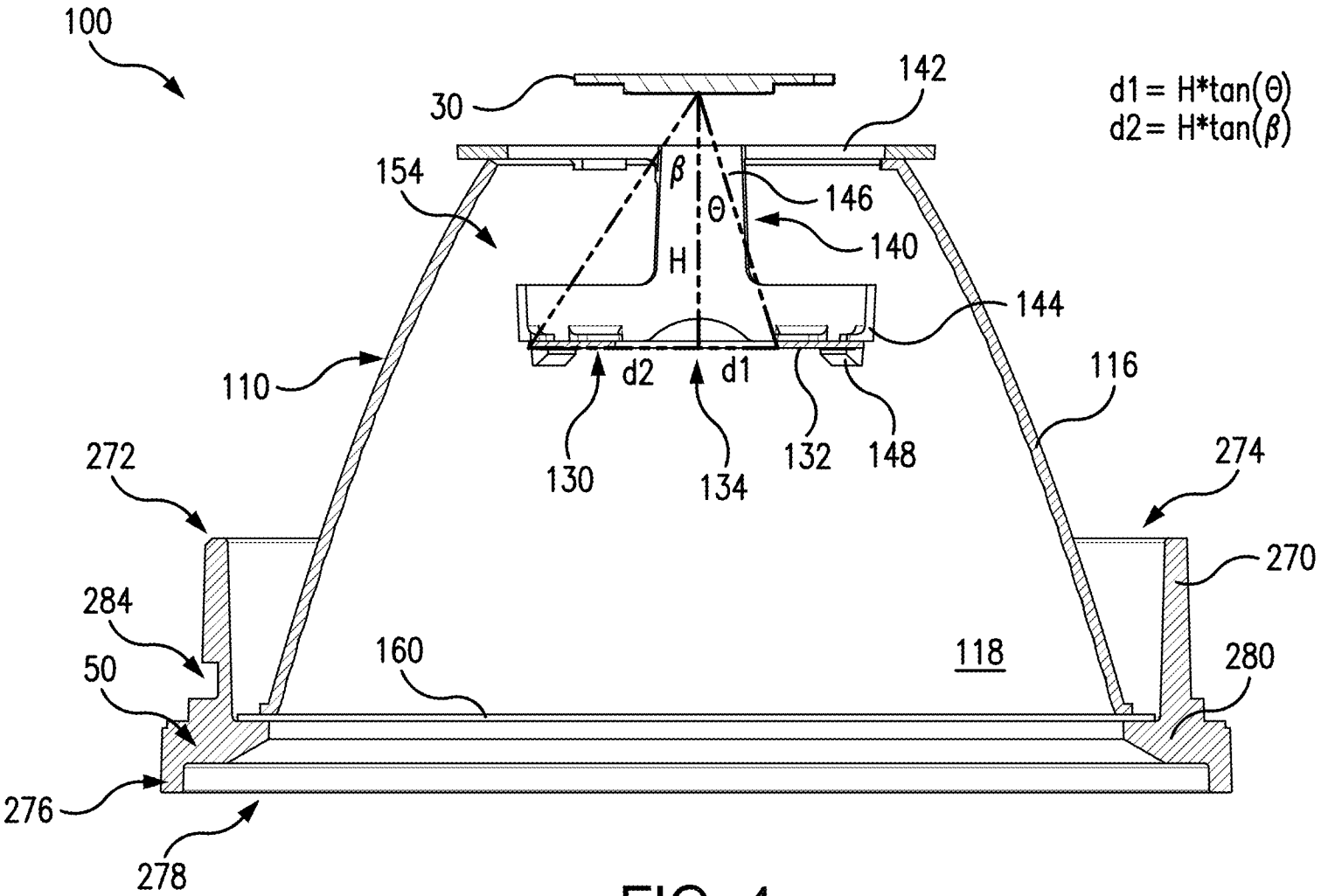
FIG. 4 illustrates another sectional view of the optical assembly, which shows an exemplary relationship between an LED light source and optical components, such as a light diffuser and a reflector, of the LED light system of FIG. 1.

FIG. 4 illustrates another sectional view of an example of the optical assembly 100, which shows an exemplary relationship between the LED light source 30 and optical components, such as the reflector 110 and the light diffuser 130 of the optical assembly 100. As shown, in this example, the light emitting surface of the LED light source 30 is substantially parallel to the light diffusing surface of the light diffuser 130. For the purposes of explanation, various lines and angles are drawn (see e.g., right-angled triangles) to specify the relationship between the LED light source 30, the reflector 110 and the light diffuser 130. For example, to reduce the harsh edge and to provide a smooth transition between the center beam light area and the peripheral area of the light beam, the LED light source 30, the reflector 110 and the light diffuser 130 can be configured in size, shape and distance to satisfy the following requirements as set forth in equations <1> and <2> below:

$$d1=H*\tan(\theta), \text{ and} \quad <1>$$

$$d2=H*\tan(\beta), \quad <2>$$

where d1 is a radius of the central opening of the light diffuser 130, d2 is a radius of the light diffuser 110, H is a height (e.g., distance or focal length) from the LED light source 30 to the light diffuser 130, θ is an angle between a centerline from the LED light source 30 to the light diffuser and a line from a center of the LED light source 30 to a perimeter of the central opening 134, and β is an angle between the centerline from the LED light source 30 to the light diffuser 130 and a line from a center of the LED light source 30 to a perimeter of the light diffuser 130.

The above-note relationship is provided as an example. It should be understood that the size, shape and position of the light diffuser 110 can be configured according to the characteristics of the LED light source and the reflector, such as the type, size, shape, position and output characteristics.

Figure 5A:
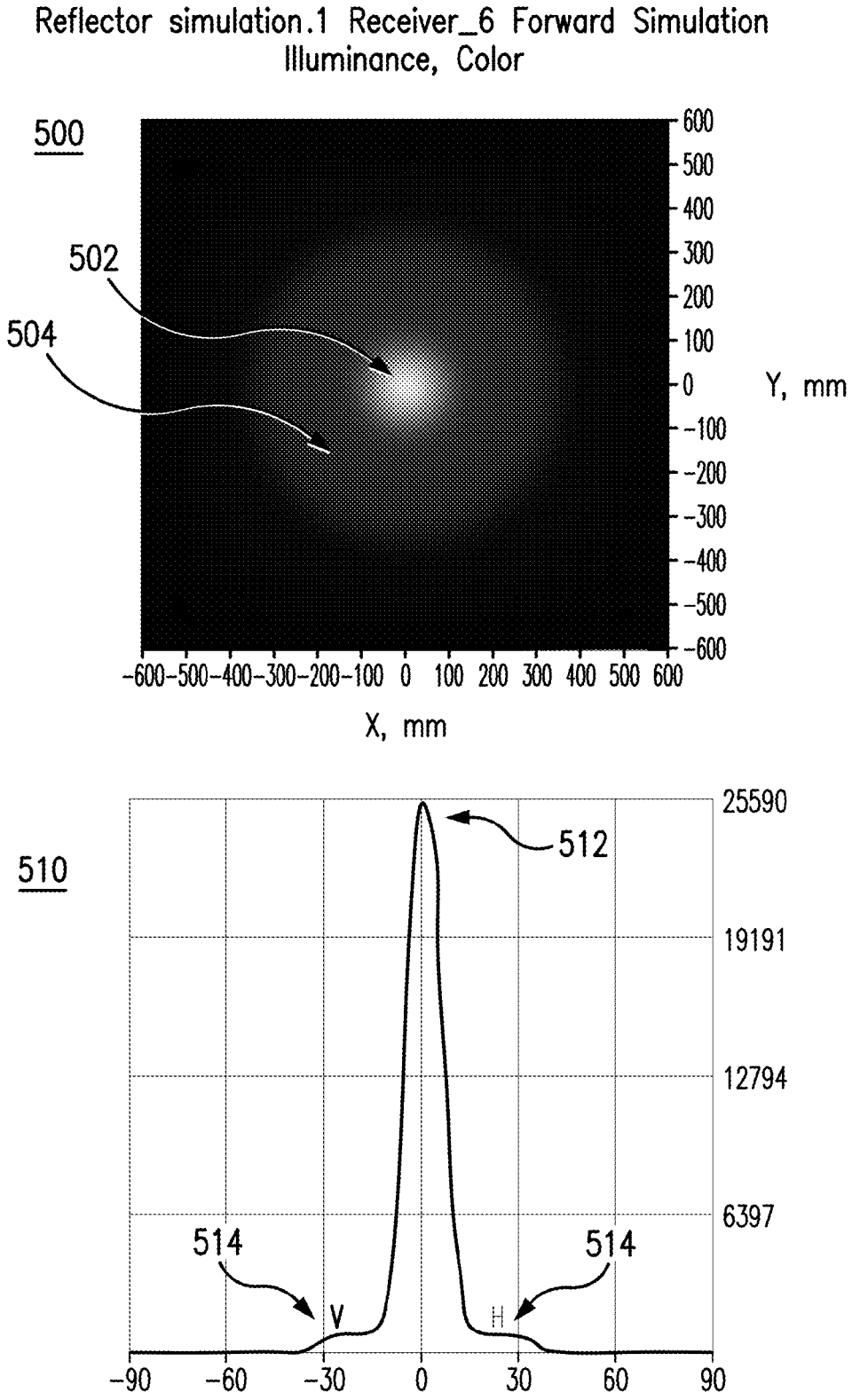
FIG. 5A illustrates an example of a simulated light pattern distribution and intensity plot for a light beam produced with an optical assembly having only a primary optic, such as a reflector.
Figure 5B:
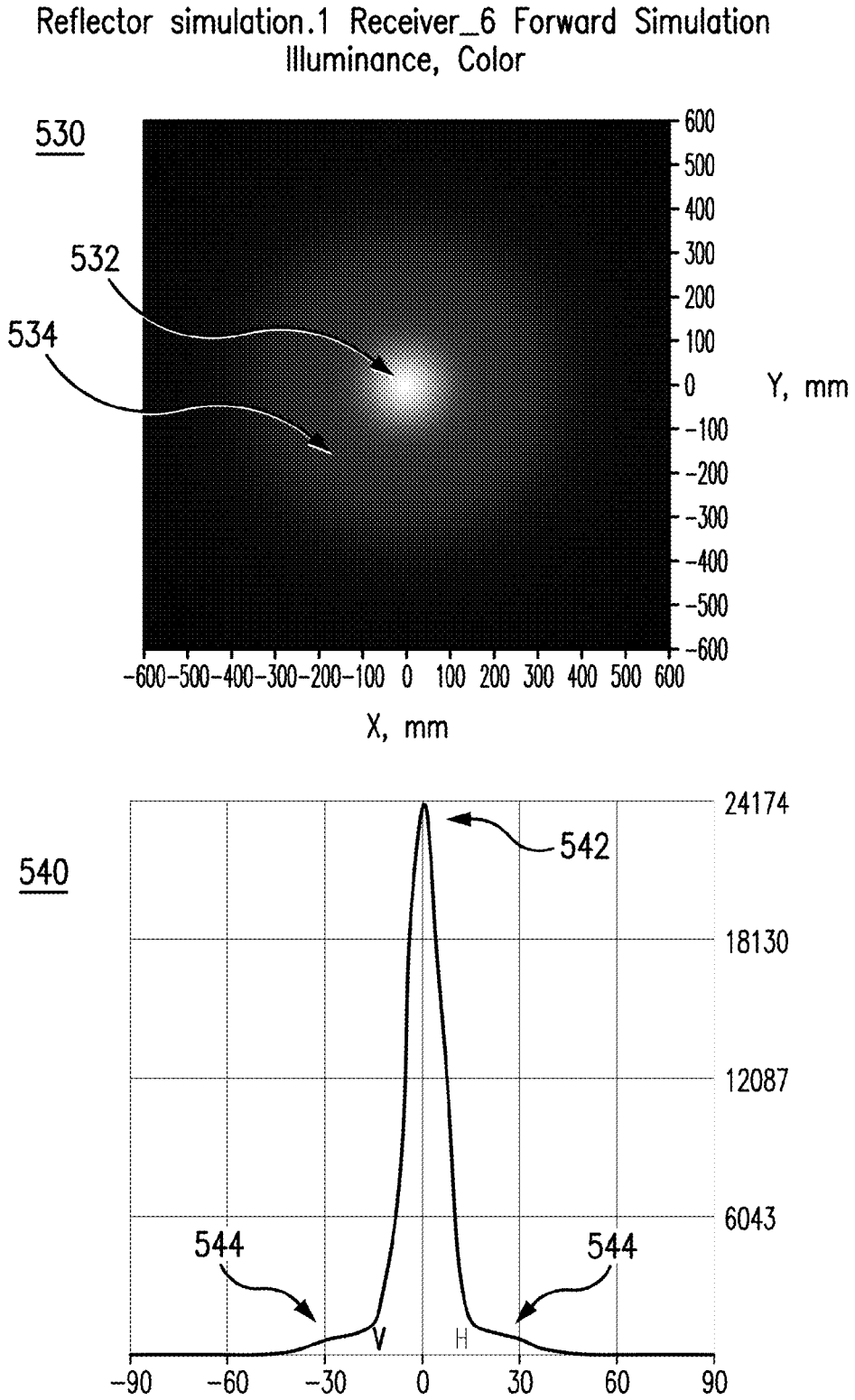
FIG. 5B illustrates an example of a simulated light pattern distribution and intensity plot for a light beam produced with an optical assembly having only a primary optic (such as a reflector) with an optical medium.
Figure 5C:
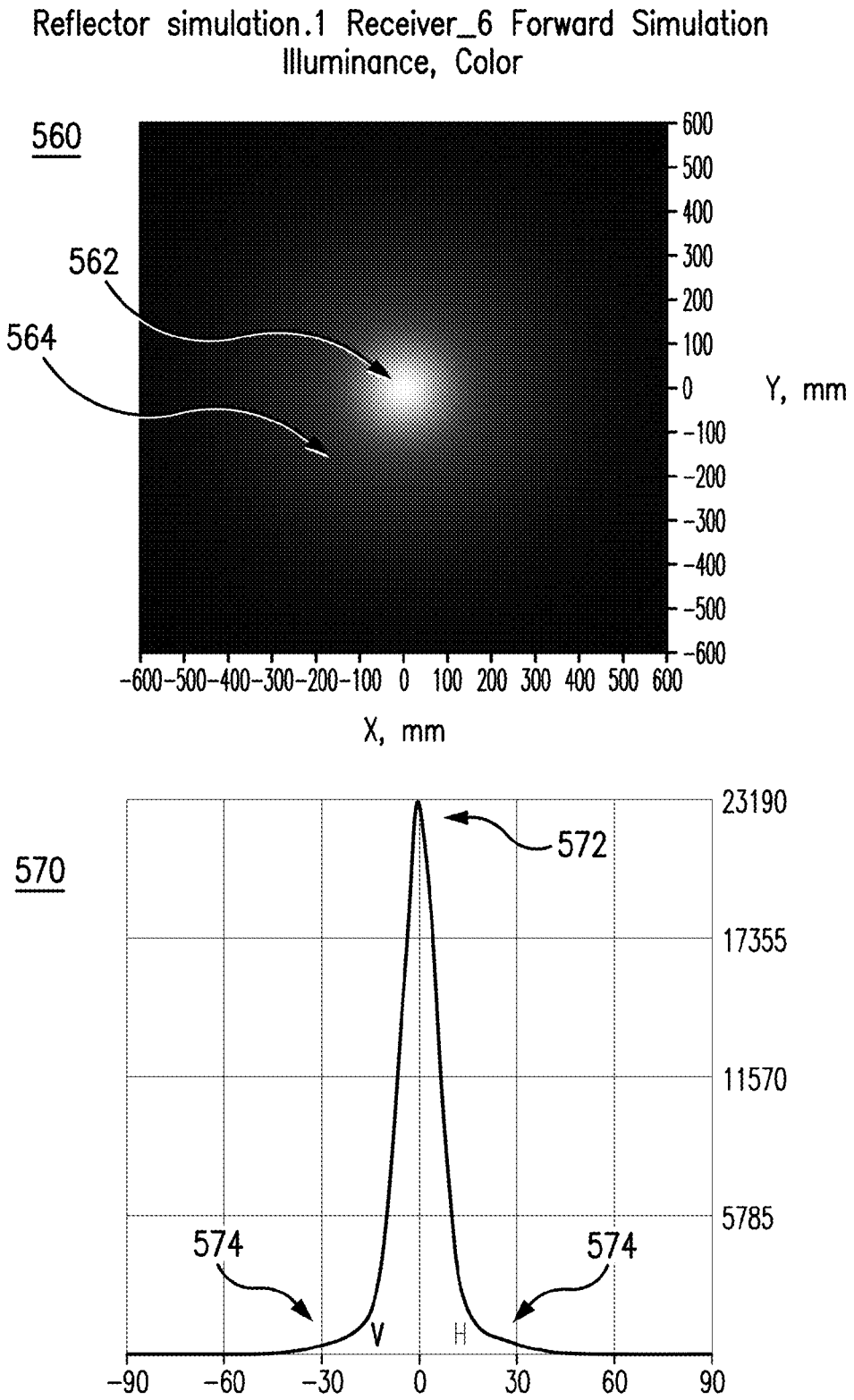
FIG. 5C illustrates an example of a simulated light pattern distribution and intensity plot for a light beam produced with an optical assembly having a primary optic (such as a reflector), secondary optic (such as a light diffuser) and an optical medium, as in the example LED light system of FIG. 1.
Figure 6A:
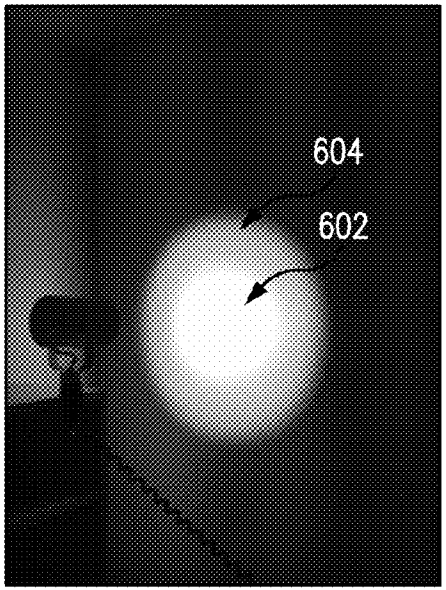
FIG. 6A illustrates an example of a light pattern distribution for a light beam produced with an optical assembly having only a primary optic, such as a reflector.
Figure 6B:
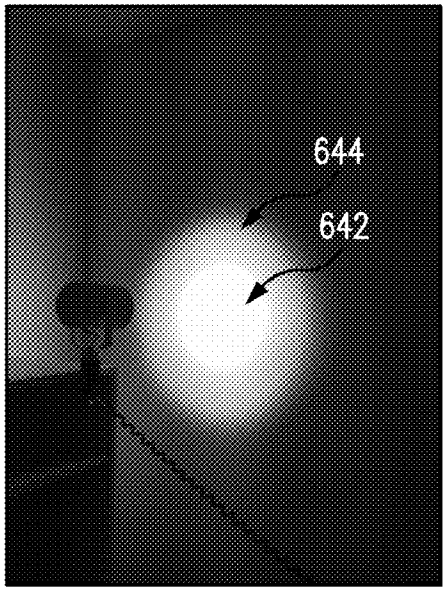
FIG. 6B illustrates an example of a light pattern distribution for a light beam produced with an optical assembly having only a primary optic (such as a reflector), and an optical medium.
Figure 6C:
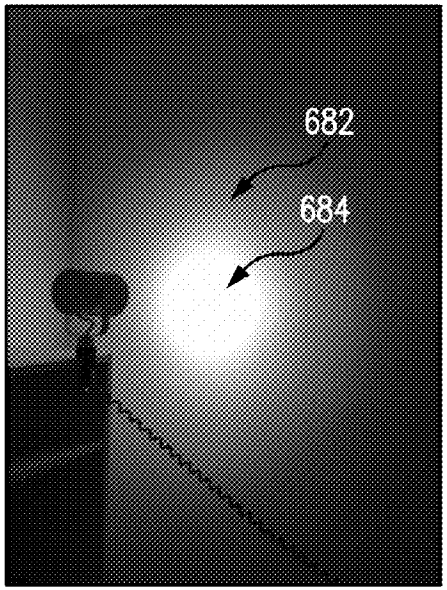
FIG. 6C illustrates an example of a light pattern distribution for a light beam produced with an optical assembly having a primary optic (such as a reflector), a secondary optic (such as a light diffuser), and an optical medium, as in the example LED light system of FIG. 1.

To evaluate the design of the optical assembly, such as in FIGS. 1-4, data was collected based on simulations and actual experiments of different optical configurations for a variety of optical assemblies (for an LED light system), which include (1) only a primary optic (e.g., in FIGS. 5A and 6A), (2) only a primary optic and an optical medium (e.g., in FIGS. 5B and 6B), and (3) a primary optic, secondary optic and an optical medium (e.g., in FIGS. 5C and 6C). In the simulated and experimented optical assemblies, the primary optic was a conical reflector, and the secondary optic was an annular disk-shaped light diffuser that was suspended inside of the reflector along the optical axis. Based on these simulations and experiments, it was shown that the use of a secondary optic, such as an annular disk-shaped light diffuser, inside of a reflector provided substantial improvement in smoothing a transition between the center beam light area and the peripheral area of the light pattern of the resultant light beam, while maintaining sufficient light output efficiency (e.g., greater than 70%, preferably between 80% and 85%) and a bright center beam. The figures, such as FIGS. 5A, 5B, 5C, 6A, 6B and 6C, will be described below in greater detail.

FIG. 5A illustrates an example of a simulated light pattern distribution 500 and an intensity plot 510 for a light beam produced by an optical assembly with only a primary optic, such as a reflector. The light pattern distribution 500 shows a center beam light area 502 and a peripheral light area 504 bordering and surrounding the center beam light area 502 in relations to horizontal (X) and vertical (Y) positions. The intensity plot 510 is a graph of light intensity versus degrees from center corresponding to the light pattern shown in the light pattern distribution 500. In the intensity plot 510, there is shown a peak light intensity 512 of a center beam forming the center beam light area 502, and a light intensity 514 of the peripheral light area 504. As shown by FIG. 5A, the use of an optical assembly with only a reflector produces a light beam with harsh edges or transition between the center beam light area 502 and the peripheral light area 504. This is similarly shown in the example light pattern distribution 600 of FIG. 6A with a center beam light area 602 and a peripheral light area 604, which were also produced by an LED light system with an optical assembly having only a reflector. As shown in both FIGS. 5A and 6A, the peripheral light areas 504 and 604, respectively, do not blend well or fade into the surrounding darkness.

FIG. 5B illustrates an example of a simulated light pattern distribution 530 and an intensity plot 540 for a light beam produced by an optical assembly with only a primary optic, such as a reflector, and an optical medium. The light pattern distribution 530 shows a center beam light area 532 and a peripheral light area 534 bordering and surrounding the center beam light area 532 in relations to horizontal (X) and vertical (Y) positions. The intensity plot 540 is a graph of light intensity versus degrees from center corresponding to the light pattern shown in the light pattern distribution 530. In the intensity plot 540, there is shown a peak light intensity 542 of a center beam forming the center beam light area 532, and a light intensity 544 of the peripheral light area 534. As shown by FIG. 5B, the use of an optical assembly with only a reflector and an optical medium also produces a light beam with harsh edges or transition between the center beam light area 532 and the peripheral light area 534. This is similarly shown in the example light pattern distribution 640 of FIG. 6B with a center beam light area 642 and a peripheral light area 644, which were produced by an LED light system with an optical assembly having only a reflector and an optical medium. As shown in both FIGS. 5B and 6B, the peripheral light areas 534 and 644, respectively, do not blend well or fade into the surrounding darkness.

FIG. 5C illustrates an example of a simulated light pattern distribution 560 and an intensity plot 570 for a light beam produced by an optical assembly including a primary optic (e.g., a reflector), a secondary optic (e.g., an annular disk-shaped light diffuser) suspended inside of the primary optic, and an optical medium. The light pattern distribution 560 shows a center beam light area 562 and a peripheral light area 564 bordering and surrounding the center beam light area 562 in relations to horizontal (X) and vertical (Y) positions. The intensity plot 570 is a graph of light intensity versus degrees from center corresponding to the light pattern shown in the light pattern distribution 560. In the intensity plot 570, there is shown a peak light intensity 572 of a center beam forming the center beam light area 562, and a light intensity 574 of the peripheral light area 564. As shown by FIG. 5C, the use of an optical assembly with the light diffuser (along with the reflector and the optical medium) produces an improved light beam with a smoother transition between the center beam light area 562 and the peripheral light area 564 in comparison to those shown in FIGS. 5A, 5B, 6A and 6B. In this example, the light intensity of the light continuously decreases from the center out towards the periphery of the light pattern of the light beam. For example, the light intensity of the light pattern from the light beam continuously decreases from the peak intensity 572 in the center beam light area 562 outwards across the peripheral light area 564. This is similarly shown in the example light pattern distribution 680 of FIG. 6C with a center beam light area 682 and a peripheral light area 684, which were also produced by an LED light system with an optical assembly having a reflector, an annular disk-shaped light diffuser, and an optical medium. As shown in both FIGS. 5C and 6C, the peripheral light areas 564 and 684, respectively, have been softened by the redistribution of light using the light diffuser, and blend well or fade into the surrounding darkness. The resulting light pattern is aesthetically pleasing particularly for spot or narrow flood light applications.

Figure 7:
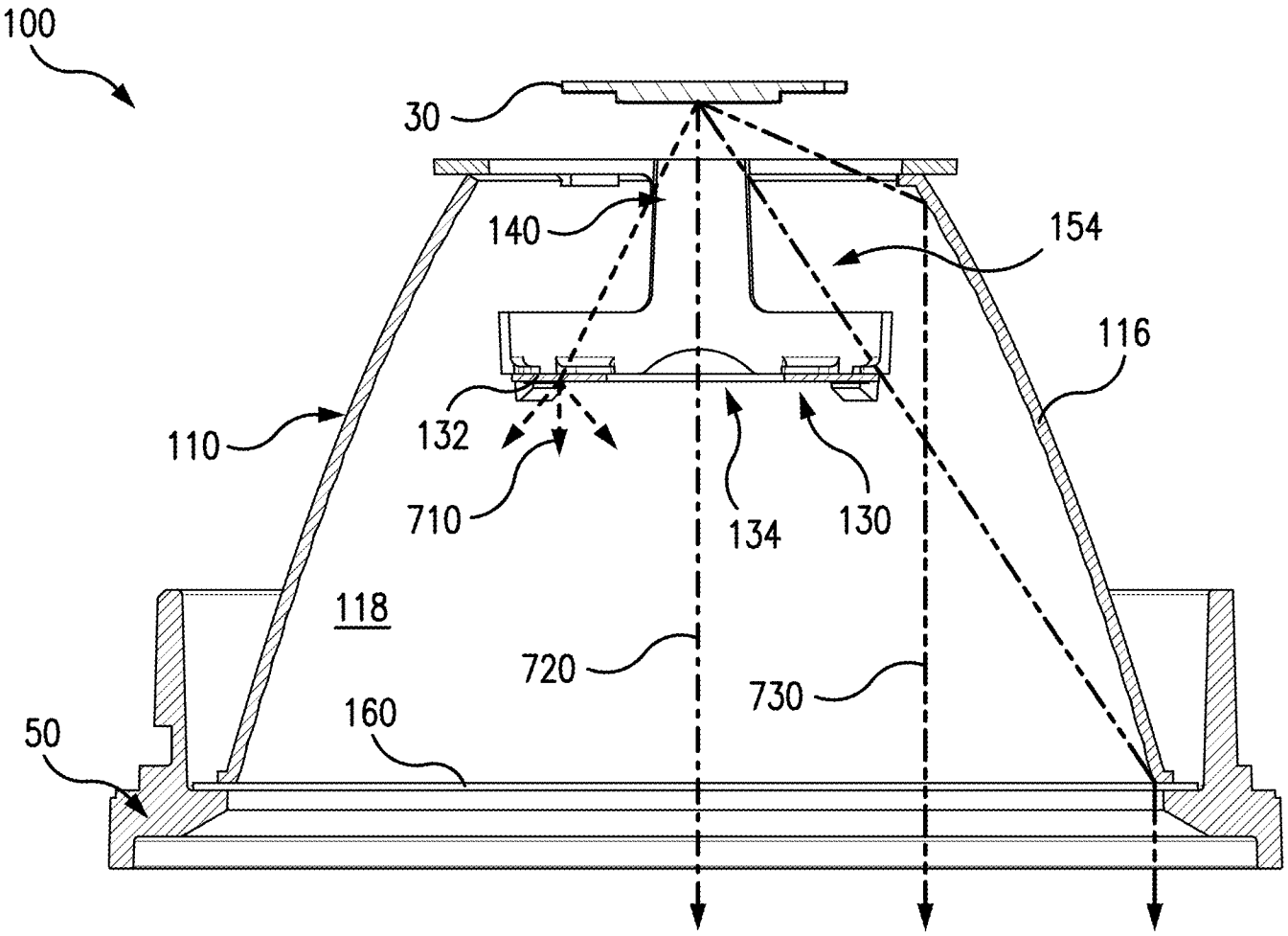
FIG. 7 illustrates another sectional view of the optical assembly of FIG. 1, which shows the various exemplary light rays passing through or acted upon by the optical components of the optical assembly, such as the reflector and the light diffuser.

FIG. 7 illustrates another sectional view of an example of the optical assembly 100, which shows the directionality of various example light rays 710, 720 and 730 passing through or reflected by the reflector 110 of the LED light system 10 of FIG. 1. As shown in FIG. 7, some of the light produced by the LED light source 30 is diffused by the light diffuser 130, as shown by the light rays 710. The redistribution of light, as shown by the diffused light rays 710, soften the peripheral light area, and thus, provide a smooth or smoother transition, without harsh edges, between the center beam light area and the peripheral light area, such as previously shown in the examples of FIGS. 5C and 6C.

As further shown in FIG. 7, a significant amount the light produced by the LED light source 30 passes directly through the central opening 134 as light rays 720 along the optical axis, without being diffused, to produce the center beam light area of the light beam. Some of the light produced by the LED light source 30 also passes through the windows 154 and the light-transmissive material of the optic holder 140 as light rays 730. The light rays 730 are reflected by the reflector 110 to contribute to the center beam light area of the light beam.

It should be understood that the optical assembly 100, as described with reference to FIGS. 1-7, is provided as an example. The size, shape and materials of the various components of the optical assembly can be modified according to the lighting application. Furthermore, the LED light system can employ other types of mechanical connectors (e.g., fasteners, screws, snap-fits, etc.) to connect the optic holder to the reflector of the LED light system, as well as to connector the other components together of the LED light system.

Words of degree, such as "about", "substantially", and the like are used herein in the sense of "at, or nearly at, when given the manufacturing, design, and material tolerances inherent in the stated circumstances" and are used to prevent the unscrupulous infringer from unfairly taking advantage of the invention disclosure where exact or absolute figures and operational or structural relationships are stated as an aid to understanding the invention.

While particular embodiments and applications of the present disclosure have been illustrated and described, it is to be understood that the present disclosure is not limited to the precise construction and compositions disclosed herein and that various modifications, changes, and variations can be apparent from the foregoing descriptions without departing from the invention.

The invention claimed is:

1. An optical assembly for an LED light system comprising:

a conical reflector having an interior reflective surface to reflect light from an LED light source, the conical reflector having a narrow open top through which light from the LED light source passes, and a wide open bottom from which light is outputted therefrom to produce a light beam along an optical axis, the light beam having a light pattern including a center beam light area and a peripheral light area surrounding the center beam light area;

a disk shaped light diffuser suspended inside of the reflector, wherein:

the light diffuser forms a substantially planar proximal surface at a first distance from the narrow open top along the optical axis, and a substantially planar distal surface at a second distance from the wide open bottom along the optical axis, the second distance being greater than the first distance, and the light diffuser redistributes a first portion of the light received thereon from the LED light source to soften the peripheral light area thereby providing a smoother transition between the center beam light area and the peripheral light area of the light beam; and an optic holder, mountable to the narrow open top of the conical reflector, to suspend the light diffuser inside of the conical reflector along the optical axis.

2. The optical assembly of claim 1, wherein the light diffuser has an annular disk-shape with a central opening therethrough, within which a second portion of the light passes unimpeded to form the center beam light area.

3. The optical assembly of claim 1, wherein a light diffusing surface of the light diffuser is substantially parallel to a light emitting surface of the LED light source.

4. The optical assembly of claim 1, wherein the optic holder is formed of a light-transmissive material.

5. The optical assembly of claim 1, wherein the optic holder comprises an upper ring, a lower ring and at least one support connected between the upper and lower rings, the upper ring being mountable onto the narrow open top of the reflector, the lower ring supporting the light diffuser.

6. The optical assembly of claim 5, wherein the upper ring has an outer diameter greater than a diameter of a top opening of the narrow open top of the reflector.

7. The optical assembly of claim 5, wherein the optic holder includes a plurality of windows between the upper ring and the lower ring, the windows allowing some of the light received from the LED light source to:

pass unimpeded through the windows, pass around a radially outermost edge of the light diffuser relative to the optical axis, reflect from the interior reflective surface of the reflector, and exit the wide open bottom of the reflector without passing through the light diffuser.

8. The optical assembly of claim 5, wherein the lower ring includes a snap-fit assembly to connect the light diffuser to the lower ring of the optic holder.

9. The optical assembly of claim 5, wherein the upper ring is disposed between the LED light source and the narrow open top of the reflector, and the at least one support extends through the opening of the narrow open top to connect with the lower ring and suspend the light diffuser within the reflector.

10. The optical assembly of claim 1, further comprising an optical medium positioned so as to cover the entirety of the wide open bottom of the reflector.

11. The optical assembly of claim 10, further comprising a media cartridge having an interior rim to support the optical medium.

12. The optical assembly of claim 1, wherein an intensity of the light pattern from the light beam continuously decreases from a peak intensity in the center beam light area outwards across the peripheral light area.

13. The optical assembly of claim 1, having only one reflector comprising the conical reflector.

14. The optical assembly of claim 1, wherein the light diffuser comprises at least one of polycarbonate, blasted glass, textured acrylic and a volumetric diffusing material.

15. An LED light system comprising:

an optic housing having an open end;

an LED light source positioned inside of the optic housing so as to emit light toward the open end of the optic housing;

an optical assembly retained within the optic housing and positioned to receive light from the LED light source, the optical assembly including:

a conical reflector having an interior reflective surface to reflect light from the LED light source, the conical reflector having a narrow open top through which the light from the LED light source passes, and a wide open bottom from which light is outputted therefrom to produce a light beam along an optical axis, the light beam having a light pattern including a center beam light area and a peripheral light area surrounding the center beam light area, a light diffuser suspended inside of the reflector, wherein:

the light diffuser forms an annular disk-shape with a central opening, the disk-shape comprising a substantially planar proximal surface at a first distance from the narrow open top along the optical axis, and a substantially planar distal surface at a second distance from the wide open bottom along the optical axis, the second distance being greater than the first distance, and the light diffuser redistributes a first portion of the light received thereon from the LED light source to soften the peripheral light area thereby providing a smoother transition between the center beam light area and the peripheral light area of the light beam, and an optic holder, mountable to the narrow open top of the conical reflector to suspend the light diffuser inside of the conical reflector along the optical axis.

16. The LED light system of claim 15, wherein the light diffuser is disposed within the reflector so that a second portion of the light passes unimpeded through the central opening to form the center beam light area.

17. The LED light system of claim 15, wherein a light diffusing surface of the light diffuser is substantially parallel to a light emitting surface of the LED light source.

18. The LED light system of claim 15, wherein:

the optic holder comprises an upper ring, a lower ring and at least one support connected between the upper and lower rings, the upper ring has an outer diameter greater than a diameter of a top opening of the narrow open top of the reflector, the upper ring is disposed between the LED light source and the narrow open top of the reflector, and the at least one support extends through the opening of the narrow open top to connect with the lower ring and suspend the light diffuser within the reflector.

19. The LED light system of claim 18, wherein the optic holder includes a plurality of the supports forming windows therebetween, the windows allowing some of the light received from the LED light source to:

pass unimpeded through the windows, pass unimpeded around the lower ring and a radially outermost edge of the light diffuser, relative to the optical axis, reflect from the interior reflective surface of the reflector, and exit the wide open bottom of the reflector without passing through the light diffuser.

20. The LED light system of claim 19, wherein the upper ring, the lower ring and the supports comprise one or more of polycarbonate, acrylic and silicone.

* * * * *